US008341980B2

(12) United States Patent
Mi et al.

(10) Patent No.: US 8,341,980 B2
(45) Date of Patent: Jan. 1, 2013

(54) INTEGRATED MULTIAXIAL ARTICLES: METHOD, APPARATUS AND FABRICS

(75) Inventors: Zhong-Xing Mi, San Leandro, CA (US); Qian Zhao, Nanjing (CN); Youjiang Wang, Atlanta, GA (US); Shijie Chen, Nanjing (CN)

(73) Assignees: Stoneferry Technology, LLC, Atlanta, GA (US); Sinoma Science & Technology Ltd., Nanjing, Jiangsu (CN)

( * ) Notice: Subject to any disclaimer, the term of this patent is extended or adjusted under 35 U.S.C. 154(b) by 0 days.

(21) Appl. No.: 13/312,217

(22) Filed: Dec. 6, 2011

(65) Prior Publication Data

US 2012/0076962 A1 Mar. 29, 2012

Related U.S. Application Data

(63) Continuation-in-part of application No. 13/049,465, filed on Mar. 16, 2011, now Pat. No. 8,161,775, which is a continuation-in-part of application No. 12/503,944, filed on Jul. 16, 2009, now Pat. No. 8,082,761.

(51) Int. Cl.
*D04B 39/06* (2006.01)

(52) U.S. Cl. ..... 66/1 R; 66/170

(58) Field of Classification Search ..... 139/383 B, 139/1 R, 384; 66/1 R, 7, 90, 116, 169 R, 66/170

See application file for complete search history.

(56) References Cited

U.S. PATENT DOCUMENTS

| | | | | | |
|---|---|---|---|---|---|
| 3,834,424 | A * | 9/1974 | Fukuta et al. | 139/22 |
| 4,001,478 | A * | 1/1977 | King | 442/205 |
| 4,066,104 | A * | 1/1978 | Halton et al. | 139/11 |
| 4,312,261 | A * | 1/1982 | Florentine | 87/33 |
| 4,346,741 | A * | 8/1982 | Banos et al. | 139/387 R |
| 4,506,611 | A * | 3/1985 | Parker et al. | 112/80.01 |
| 4,518,640 | A * | 5/1985 | Wilkens | 428/102 |
| 4,863,660 | A * | 9/1989 | Cahuzac et al. | 264/103 |
| 5,085,252 | A * | 2/1992 | Mohamed et al. | 139/22 |
| 2005/0235471 | A1 * | 10/2005 | Delecroix | 28/107 |

* cited by examiner

*Primary Examiner* — Danny Worrell
(74) *Attorney, Agent, or Firm* — Morris, Manning & Martin, LLP; Tim Tingkang Xia, Esq.

(57) ABSTRACT

Integrated multiaxial articles are formed of yarns arranged in multiaxial direction in a plurality of layers bound together by a set of through-the-layers yarns. Methods and apparatus of making same are presented. Hollow integrated multiaxial fabric and its variants are introduced.

31 Claims, 11 Drawing Sheets

700

INTEGRATED MULTIAXIAL ARTICLES: METHOD, APPARATUS AND FABRICS

CROSS-REFERENCE TO RELATED PATENT APPLICATIONS

This application is a continuation-in-part of U.S. patent application Ser. No. 13/049,465, filed Mar. 16, 2011, now U.S. Pat. No. 8,161,775, entitled "INTEGRATED HOLLOW FABRIC STRUCTURE", by Zhong-Xing Mi, Qian Zhao, Youjiang Wang and Shijie Chen, which itself is a continuation-in-part of U.S. patent application Ser. No. 12/503,944, filed Jul. 16, 2009, now U.S. Pat. No. 8,082,761, entitled "METHOD OF FORMING INTEGRATED MULTIAXIAL FABRICS", by Youjiang Wang, Qian Zhao, Zhong-Xing Mi and Jianzhong Zhang, the disclosures of which are incorporated herein by references in their entireties.

Some references, which may include patents, patent applications and various publications, are cited and discussed in the description of this invention. The citation and/or discussion of such references is provided merely to clarify the description of the present invention and is not an admission that any such reference is "prior art" to the invention described herein. All references cited and discussed in this specification are incorporated herein by reference in their entireties and to the same extent as if each reference were individually incorporated by reference.

FIELD OF THE INVENTION

This invention generally relates to integrated multiaxial articles, and more particularly to integrated multiaxial articles having a prescribed integration pattern formed of winding yarns arranged in multiaxial direction at prescribed angles in a plurality of layers bound together by a set of through-the-layers binding yarns.

BACKGROUND OF THE INVENTION

Integrated multiaxial articles have wide applications such as advanced composites, power transmission and conveyer belts, fabrics in paper forming machines, among others.

Advanced composites include high performance fibers in a matrix. Depending on the fibers, matrix materials and manufacturing parameters, advanced composites offer superior strength-to-weight and modulus-to-weight ratios, fatigue strength, damage tolerance, tailored coefficient of thermal expansion, chemical resistance, weatherability, temperature resistance, among others.

Fibers are the basic load-bearing component in a fiber reinforced composite. They are often pre-assembled into various forms to facilitate the fabrication of composite parts. Advanced composites are often made from prepreg tapes, sheets and fabrics that are parallel continuous fibers or single-layer fabrics held by a matrix forming material. They are used to make parts by laminate layup and tape or filament winding. The traditional laminated composites are vulnerable to delamination because the layers of strong fibers are connected only by the matrix material that often is much weaker than the fibers. Integrated fiber structures with the introduction of fiber reinforcement in the through-the-thickness direction could effectively control delamination failures and make the composite very damage tolerant. Besides performance enhancement, composites reinforced with integrated fiber structures may also offer other advantages such as high level of automation, high production rates, reproducibility, flexibility and lower manufacturing cost.

Planar multiaxial fabrics having layers of parallel fibers at predetermined angles bound by a knitting process, known as non-crimp fabrics, are also commonly used in reinforced composites. Methods of making such planar multiaxial fabrics are disclosed in U.S. Pat. No. 4,518,640 to Wilkens. These methods are suitable for making flat fabrics with fixed width and yarn orientations. The in-plane layers normally include high performance fibers such as glass and/or graphite fibers, whereas the knitting yarns generally are made of flexible fibers such as poly(ethylene terephthalate) (PET) or aramid rather than using the same type of high performance fibers as in the in-plane layers.

Fabrics with solid rectangular or other cross sectional shapes such as I and T sections may be constructed with reinforcing fibers in both in-plane and through-the-thickness directions by three dimensional weaving and braiding processes, as disclosed in, for examples, U.S. Pat. No. 4,312,261 to Florentine and U.S. Pat. No. 5,085,252 to Mohamed et al. These processes are generally limited in the cross sectional shapes and dimensions of the fabrics that can be produced.

Fully interlocked and adjacent layer interlocked fabrics may be formed by weaving or braiding according to, for example, U.S. Pat. No. 4,174,739 to Rasero et al. In such fabrics the yarns are crimped due to yarn interlacing or intertwining, and the yarn crimps in the fabrics cause a reduction in the stiffness and strength of the composites reinforced with such fabrics. Although the fabrics layers are integrated by interlocking, there are no reinforcing yarns placed directly in the through-the-thickness direction.

Composite parts reinforced with hollow fabrics are widely used for many applications. Hollow fabrics such as tubular structures may be constructed directly from yarns, as disclosed in, for example, U.S. Pat. No. 4,001,478 to King, and U.S. Pat. No. 4,346,741 to Banos et al. and U.S. Pat. No. 6,129,122 to Bilisik. In all these disclosures, the yarns are primarily arranged in the axial, circumferential and radial directions, respectively. More particularly, the yarns in the axial direction are required as part of the fabrics structure, whereas the yarns in the circumferential direction at an angle close to 90° to the axis are placed into the fabric along a single direction only. These disclosures cannot afford hollow integrated multiaxial fabrics with yarns of the formed fabrics oriented in directions other than or in addition to the axial, circumferential and radial directions.

The traditional methods and machines of forming integrated fabrics lack in the flexibility of varying the fiber orientation, the cross sectional shape, dimension and are unable to provide hybrid structures of which the fiber architecture may change from location to locations as the fabrics are being formed, more specifically are unable to make hollow integrated multiaxial fabrics. They are often associated with other disadvantages such as low level of automation, low production rate, lack in flexibility and high manufacturing cost. And the traditional integrated hollow fabrics are not multiaxial structures for the lack of flexibility of varying the fiber orientations and forming hybrid structures of which the fiber architecture may vary from location to locations, among others.

Therefore, a heretofore unaddressed need exists in the art to address the aforementioned deficiencies and inadequacies.

SUMMARY OF THE INVENTION

The disclosure of this invention overcomes the above mentioned limitations and disadvantages of the existing methods and machines for forming integrated fabrics, so that articles with simple as well as complex shapes can be made without yarn interlacing or intertwining. The disclosure of this invention provides a novel hollow integrated multiaxial fabric and its variants with fibers of non-crimp. This invention provides a process of high level of automation, high production rate, reproducibility and flexibility with low production cost, among other advantages.

In one aspect, the present invention relates to a method for fabricating integrated multiaxial fabrics having a prescribed integration pattern with winding yarns and binding yarns. In one embodiment, the method includes the step of providing a plurality of winding yarn carriers arranged in a multilayer form along a first direction and configured such that each winding yarn carrier is operationally movable with respect to one another along a second direction that is perpendicular to the first direction. Each winding yarn carrier has a set of spatially-separated winding yarns supplied from yarn package(s) mounted on the corresponding winding yarn carrier to form a winding yarn layer, whereby the supplied winding yarns from the plurality of winding yarn carriers form a plurality of winding yarn layers. In one embodiment, the plurality of winding yarn arranged such that the winding yarns form a plurality of winding yarn layers at prescribed angles in ranges from about 0° to about ±90° with respect to the first direction that is coincident with the longitudinal direction of the formed integrated multiaxial fabrics.

The method further includes the step of (a) forming a plurality of crossover points of the winding yarns by moving at least one winding yarn carrier along the second direction according to the integration pattern; (b) transporting the binding yarns through the plurality of winding yarn layers at predetermined locations along the first direction, and locking the binding yarns in place; (c) pushing the binding yarns toward the fell of the integrated multiaxial fabric; (d) taking up the formed integrated multiaxial fabric; and (e) repeating steps (a)-(d) until the integrated multiaxial fabric is fabricated to have desired dimensions.

The method may also include the step of removing slacks in the binding yarns before the taking up step is performed.

In one embodiment, the binding yarns are carried by a binding yarn insertion system. The binding yarn insertion system has at least one binding yarn insertion needle, positioned in relation to the plurality of winding yarn carriers. Pluralities of binding yarn insertion needles are preferred. The transporting step is performed by passing the binding yarn insertion needle(s) through the plurality of winding yarn layers at the predetermined locations along the first direction, so as to fasten the plurality of winding yarn layers together through-the-layers. Transporting the binding yarn insertion needle(s) at the next binding location may be executed or omitted according to the prescribed integration pattern of binding the plurality of winding yarn layers before next cycle of fabric formation.

In one embodiment, the prescribed integration pattern is formed by controlling the number of the winding yarn layers, relative distances of the winding yarn carrier movements, and activation or omission of the binding yarns in operation.

In one embodiment, the method allows the use of binding yarns that can be different in type, such as, but not limited to, filament yarn, staple yarn and tape; in form, such as, but not limited to, solid and tubular in cross sectional shape; in material and in size, among others.

In one embodiment, the method allows the use of more than one binding yarns, if needed, that can be transported by binding yarn insertion system through the plurality of winding yarn layers at a predetermined location along the first direction. In this case, at least one binding yarn is acting to fasten the plurality of winding yarn layers together through-the-layers.

In one embodiment, the method allows various structures to be formed, including hybrid structures of which the fiber architecture varies from location to locations, by controlling the relative movements among winding yarn carriers, the relative speed of each winding yarn carrier relative to the speed of fabric take-up, and/or the patterns of binding the winding yarn layers. The movements of the winding yarn carrier can be continuous, step-wise, reciprocating and/or stationary.

In another aspect, the present invention relates to an apparatus for fabricating integrated multiaxial fabrics having a prescribed integration pattern. In one embodiment, the apparatus has a plurality of winding yarn carriers arranged in a multilayer form along a first direction and configured such that each winding yarn carrier is operationally movable with respect to one another along a second direction that is perpendicular to the first direction. Each winding yarn carrier has a set of spatially-separated winding yarns supplied from yarn package(s) mounted on the corresponding winding yarn carrier to form a winding yarn layer, whereby the supplied winding yarns from the plurality of winding yarn carriers form a plurality of winding yarn layers. The movements of one or more winding yarn carriers in opposite directions create a plurality of crossover points by the corresponding winding yarns. Each winding yarn carrier can be moved angularly or translationally along the second direction.

The apparatus also has a binding yarn insertion system. The binding yarn insertion system has at least one binding yarn insertion needle, positioned in relation to the plurality of winding yarn carriers for transporting binding yarn through the plurality of winding yarn layers at the predetermined locations along the first direction, so as to fasten the plurality of winding yarn layers together through-the-layers, and at least one beating bar adapted for inserting through openings of the laid winding yarns for a beat-up motion at a predetermined time to push the binding yarns toward the fell of the fabrics.

In one embodiment, the apparatus further comprises a plurality of shaping rings and a moving ring adapted for condensing the plurality of winding yarn layers and supporting the winding yarn layers while the binding yarns are inserted and during the beat-up motion. The position of the moving ring is changeable during each cycle of fabric formation.

In one embodiment, the apparatus further comprises a unit after shaping rings for condensing the formed integrated multiaxial fabric.

The apparatus may also have at least one holding yarn feeding needle accompanying and positioned in relation to the binding yarn insertion system such that when the binding yarn insertion needle(s) insert the binding yarns through the plurality of winding yarn layers to form open loops by folding the binding yarns, the holding yarn feeding needle and the holding yarn insertion needle move a holding yarn through the binding yarn open loops to lock the binding yarns in the fabrics.

In addition, the apparatus may further have an auxiliary bar accompanying each binding yarn insertion needle for keeping the binding yarn loop open while the holding yarn is inserted, and for tightening the binding yarn after the holding yarn is inserted while limiting the bending curvature in the binding yarn as it is tightened.

In one embodiment, the apparatus may include a knitting mechanism having a needle and a yarn feeder to form a loop of the holding yarn that goes through the open loop of the folded binding yarn, wherein the holding yarn is adapted for holding the binding yarn in place, and preventing the binding yarn from being pulled out as the binding yarn insertion needle retreats and the slacks in the binding yarn is removed.

In one embodiment, the apparatus has one or more tensioning control devices placed in each winding yarn carrier for regulating the tension of the winding yarns as the winding yarns are withdrawn, and a braking mechanism associated with the one or more tension control devices for preventing the winding yarns from being withdrawn during the beat-up motion.

In yet another aspect, the present invention relates to a method for fabricating the integrated multiaxial fabrics having a prescribed integration pattern in connection with an apparatus having a plurality of winding yarn carriers arranged in a multilayer form along a first direction and configured such that each winding yarn carrier is operationally movable with respect to one another along a second direction that is perpendicular to the first direction, wherein each winding yarn carrier has a set of spatially-separated winding yarns supplied from yarn package(s) mounted on the corresponding winding yarn carrier to form a winding yarn layer, whereby the supplied winding yarns from the plurality of winding yarn carriers form a plurality of winding yarn layers, and wherein the movements of one or more winding yarn carriers in opposite directions create a plurality of crossover points by the corresponding winding yarns; a binding yarn insertion system with at least one binding yarn insertion needle positioned in relation to the plurality of winding yarn carriers; a holding yarn feeding needle and a holding yarn insertion needle having a hook, positioned in relation to the binding yarn insertion system; and at least one beating bar.

In one embodiment, the method includes the steps of (a) moving at least one winding yarn carrier along the second direction according to the integration pattern to form a plurality of crossover points of the winding yarns; (b) inserting the binding yarn insertion needle(s) through the plurality of winding yarn layers at predetermined locations along the first direction for transporting the binding yarns through the plurality of winding yarn layers to form open loops by folding the binding yarns; (c) locking the inserted binding yarns in place, so as to fasten the plurality of winding yarn layers together through-the-layers; (d) inserting at least one beating bar through openings of the laid winding yarns for a beat-up motion at a predetermined time to push the binding yarns toward the fell of the fabrics; (e) taking up the formed integrated multiaxial fabrics at a predetermined rate; and (f) repeating steps (a)-(e) until the integrated multiaxial fabrics are fabricated to have desired dimensions.

In one embodiment, the motion of locking the binding yarns in place comprises the steps of (a) inserting the holding yarn insertion needle through a binding yarn loop; (b) retreating the binding yarn insertion needle associated with the bind yarn loop from the top surface of the fabrics without tightening the binding yarn; (c) moving the holding yarn feeding needle inward to feed a holding yarn to the hook of the holding yarn insertion needle; (d) retreating the holding yarn insertion needle through the binding yarn loop and lock the holding yarn into a prior holding yarn loop; (e) tightening the binding yarn as the holding yarn insertion needle retreats further; and (f) moving the holding yarn insertion needle circumferentially to a next binding yarn loop; and (g) repeating steps (a)-(f) until all the binding yarns are locked and tightened in place.

In one embodiment, the method further includes the step of beating up the winding yarn layers before the inserting step is performed.

In further aspect, the present invention relates to a hollow integrated multiaxial fabric in a generally cylindrical shape having a central axis, and comprising at least first and second groups of winding yarns, each group having a plurality of winding yarns regularly arranged in one or more layers, where the winding yarn layers of the first and second groups are alternately stacked in the radial direction to define an inner surface, an outer surface and a radial thickness therebetween, and the plurality of winding yarns of the first group is helically oriented at a first angle, $\alpha 1$, relative to the central axis, and the plurality of winding yarns of the second group is helically oriented at a second angle, $\alpha 2$, relative to the central axis, thereby defining a plurality of crossovers of winding yarns. The angle $\alpha 1$ of different winding yarn layers of the first group may be the same or substantially different. Similarly, the angle $\alpha 2$ of different winding yarn layers of the second group may be the same or substantially different. In one embodiment, $-90° < \alpha 1 < 90°$, $-90° < \alpha 2 < 90°$, and $\alpha 1 = -\alpha 2$. In another embodiment, $-90° < \alpha 1 < 90°$, $-90° < \alpha 2 < 90°$, and $\alpha 1 \neq -\alpha 2$.

In one embodiment, the plurality of winding yarns of each group is disposed substantially in parallel to one another.

The hollow integrated multiaxial fabric further comprises a plurality of binding yarns. Each binding yarn defines alternately a plurality of binding loops and a plurality of holding loops interlaced with corresponding crossovers formed by winding yarns for interlocking the winding yarn layers of the first and second groups, where each binding loop receives at least one crossover at the inner surface and each holding loop is placed between crossovers and exposed to the outer surface. The hollow integrated multiaxial fabric may also comprise at least one holding yarn received in the holding loops of the plurality of binding yarns.

In one embodiment, the plurality of binding loops and the plurality of holding loops of each binding yarn define a plane. The plurality of binding loops and the at least one holding yarn are disposed on the surface of the fabric.

In yet further another aspect, the present invention relates to a hollow integrated multiaxial fabric including a body with an axis and a thickness along a direction perpendicular to the axis, at least first and second groups of yarns, the yarns of each group space-regularly disposed in layers, where the yarn layers of at least two groups of yarns are alternately stacked and interlocked together, and embedded in the body; and a third group of yarns through the thickness of the body to interlock the layers together, where the positions and the pattern of interlocking vary according to the need.

In one embodiment, the yarns of each group are disposed substantially in parallel respect to one another and are inclined with respect to the axis of the body. The yarns of the first and second groups define a plurality of crossovers. The yarns of the first group are inclined at a first angle, $\alpha 1$, relative to the axis of the body, and the yarns of the second group are inclined at a second angle, $\alpha 2$, relative to the axis of the body, where $-90° < \alpha 1 < 90°$, $-90° < \alpha 2 < 90°$, and $\alpha 1 = -\alpha 2$. In another embodiment, $-90° < \alpha 1 < 90°$, $-90° < \alpha 2 < 90°$, and $\alpha 1 \neq -\alpha 2$.

In one embodiment, the body has a cross sectional profile that is in a regular or irregular shape, where the cross sectional profile varies along the axis direction.

In one embodiment, the body is formed of material, stable or unstable at the elevated temperature. In another embodiment, the body is formed of carbonaceous or non carbonaceous.

In one embodiment, the hollow integrated multiaxial fabric has a cross-sectional geometry in an irregular or regular shape, such as, an integrated hollow circular, an integrated hollow oval, an integrated hollow square, an integrated hollow rectangle, and wherein the hollow integrated multiaxial fabric has a thickness that is uniform or variable.

The present invention provides a method for forming integrated multiaxial fabrics having a variety of constant or variable cross sectional shapes, constant or variable fiber orientation and integration patterns. In the integrated multiaxial fabrics, there are two systems of yarns, one is the system of winding yarns and the other is the system of binding yarns. The winding yarns are arranged in a plurality of layers at prescribed angles that can vary in ranges from about 0° to about ±90° with respect to longitudinal direction of the fabrics. The binding yarns are to fasten, through-the-layers, the layers of winding yarns together. An auxiliary system of holding yarns may be used to lock the binding yarns in place. Since the primary function of the holding yarns is not to provide structural strength and stiffness to the fabrics structure but to simply hold the binding yarns in place, flexible fibers such as nylon or PET threads may be used as the holding yarns. The supply yarns to form each layer of winding yarns are placed in an individual carrier. Fabrics with desired cross sectional shape, fiber orientation and integration patterns is formed by repeating a cycle of operations which includes the following steps: forming a plurality of new cross over points of the winding yarns by moving each of the winding yarn carriers according to the integration pattern; transporting a plurality of the binding yarns through the layers of the winding yarns at desired locations and locking the binding yarns in place; pushing the binding yarns to the position to form the fabrics and removing any slacks in the yarns and taking up the newly formed fabrics by a controlled distance in the direction of the machine direction, i.e., the longitudinal direction of the fabrics. The integrated multiaxial fabrics having variable cross sectional shapes, variable fiber orientations, and variable integration patterns are formed by controlling the number of fiber layers engaged, the relative distances of the winding yarn carriers movement, and activation or omission of binding yarns as the forming process proceeds.

It is therefore the object of this invention to provide a method and an apparatus for forming integrated multiaxial fabrics, of a desired cross-sectional geometry in closed and/or opened form, consisting of multiple layers of fibers bound together by through-the-layers binding yarns, each layer following prescribed fiber orientation, and the fibers in the layers being not interlaced or intertwined.

It is another object of this invention to provide a method and an apparatus for forming integrated multiaxial fabrics of desired cross sectional geometry. Examples of the cross sections include regular or irregular hollow or opened forms, and regular or irregular solid shapes such as I-section, T-Section, U-Section, and flat section, among others.

It is yet another object of this invention to provide a method and an apparatus for forming integrated multiaxial fabrics of variable cross-sectional geometry such that the cross-sectional dimensions can vary along the lengthwise direction of the fabrics.

It is a further object of this invention to provide a method and an apparatus for forming integrated multiaxial fabrics of variable cross-sectional geometry such that the shape can vary along the lengthwise direction of the fabrics.

It is yet a further object of this invention to provide a method and an apparatus for forming integrated multiaxial fabrics of variable cross-sectional geometry such that the wall thickness for the fabrics in a hollow form, or the thickness of the fabrics in solid form, can vary along the lengthwise direction of the fabrics.

It is one object of this invention to provide a method and an apparatus for forming integrated multiaxial fabrics of variable cross sectional geometry such that the wall thickness for hollow sectioned fabrics can vary within the cross-sectional and along the length of the fabrics.

It is another object of this invention to provide a method and an apparatus for forming integrated multiaxial fabrics of variable cross sectional geometry such that the integration pattern can vary by the fixation or omission of selected binding yarns or by the method of binding yarn fixation.

It is yet another object of this invention to provide a method and an apparatus for forming integrated multiaxial fabrics in which the fiber orientation of each layer may vary along the lengthwise direction of the fabrics.

It is a further object of this invention to provide a method and an apparatus for forming integrated multiaxial fabrics with various fiber structures and/or their hybrids.

It is yet a further object of this invention to provide a method and an apparatus for forming integrated multiaxial fabrics by withdrawing yarns to form the fabrics layers from the yarn supply packages without paying back thus eliminating the need for springs or elastic bands for paying out and pulling back yarns as required in common two dimensional and three dimensional braiding processes.

It is yet a further object of this invention to provide a method and an apparatus for forming integrated multiaxial fabrics by controlling yarn tensions with direct tension control devices facilitated by the fact the yarns forming the fabrics layers only move in one direction from the packages without the need to compensate for yarn paying back.

It is another further object of this invention to provide a hollow integrated multiaxial fabric and its variants having a body with an axis and a thickness along a direction perpendicular to the axis, at least first and second groups of yarns, the yarns of each group space-regularly disposed in layers and inclined with respect to the axis of the body at a first angle, $\alpha 1$ and a second angle, $\alpha 2$, relative to the axis of the body, where $-90° < \alpha 1 < 90°$, $-90° < \alpha 2 < 90°$, respectively, a plurality of crossovers defined by the yarns of the first and second groups, where the yarn layers of at least two groups of yarns are alternately stacked and interlocked together, and embedded in the body; and a third group of yarns through the thickness of the body to interlock the layers together, where the positions and the pattern of interlocking vary according to the need.

It is yet another object of this invention to provide a hollow integrated multiaxial fabric and its variants having improved structural properties including more uniform resistance to deformation, integrity and isotropic strength, if required, in the fabric surface directions, respectively.

Yet, an alternative object of the present invention is to provide a hollow integrated multiaxial fabric and its variants in which the yarn orientation of each layer may vary along the lengthwise direction and/or in the thickness direction of the fabrics, if required.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention only. The shapes, positions, quantities, and movements of parts in the drawings are to illustrate the execution of functions and processing steps and they are by no means represent all the possible alternative implementations covered by this invention. Obviously, the vertically setup apparatus can be easily converted to non-vertically version. Wherever possible, the same reference numbers are used throughout the drawings to refer to the same or like elements of an embodiment, wherein.

DETAILED DESCRIPTION OF THE INVENTION

Figure 1:
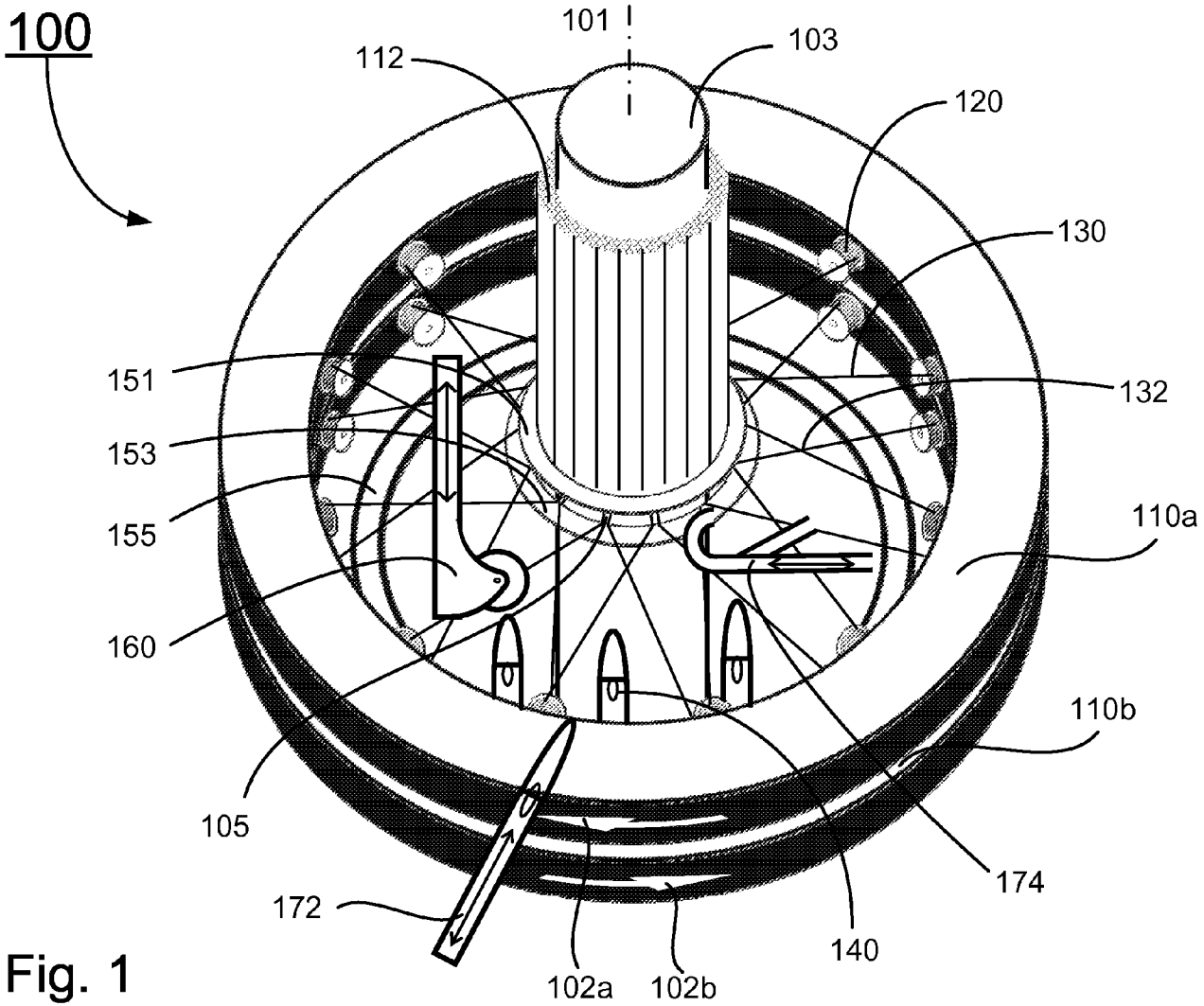
FIG. 1 shows schematically an apparatus for fabricating integrated multiaxial fabrics according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Yet, as used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

The term, "yarn", as used herein, refers to a linear body including fibers or an assembly of fibers. It may be in the form of spun yarns, mono or multi filament yarns, singles yarns, plied yarns, or other form of strands. It may contain fibers that are twisted together or untwisted. It may also be in the form of a preimpregnated (prepreg) strand/tape including a reinforcing fiber and a matrix-forming material. The fibers may be made of different materials including but not limited to carbon, glass, aramid or a combination of different fibers (hybrids).

As used herein, the terms inner surface and outer surface refer to the inner wall and outer wall of the fabric, respectively. They may also refer to any two surfaces on the opposite sides of the fabric.

As used herein, the terms "comprising", "including", "having", "containing", "involving" and the like are to be understood to be open-ended, i.e., to mean including but not limited to.

The description will be made as to the embodiments of the present invention in conjunction with the accompanying drawings in FIGS. 1-9. In accordance with the purposes of this invention, as embodied and broadly described herein, this invention, in one aspect, relates to hollow integrated multiaxial fabrics formed of yarns arranged in a plurality of layers at prescribed angles bound together by a set of through-the-layers yarns, and a method and an apparatus of forming the integrated multiaxial fabrics that can be tailored to have a variety of constant or variable cross sectional shapes, constant or variable fiber orientation and integration patterns according to requirements for local fiber architecture and fabrics geometry.

According to the present invention, integrated multiaxial fabrics are fabricated with two systems of yarns: the winding yarns and the binding yarns. The winding yarns are arranged in a plurality of layers at prescribed angles that can vary in the ranges from about 0° to about ±90° with respect to longitudinal direction of the fabrics. The binding yarns are used to fasten, through-the-layers, the layers of winding yarns together. The binding yarns may form loops to lock themselves in the fabric, or an auxiliary system of holding yarns may be used to lock the binding yarns in place. The supply yarns to form each layer of winding yarns are placed in an individual carrier. The number of the layers of winding yarns can be varied as desired but limited by the number of winding yarn carriers in the apparatus. In one embodiment, the layers of winding yarns may be shaped by an optional mandrel of appropriate geometry along the machine direction to form hollow fabrics or fabrics with a core. The winding yarn orientations for the individual layers can be altered for different locations within the fabrics as the fabrics are being formed. Fabrics with desired cross sectional shape, yarn orientation and integration patterns are formed by repeating a cycle of operations which includes the following steps: forming a plurality of new cross over points of the winding yarns by moving each of the winding yarn carriers according to the integration pattern; transporting a plurality of the binding yarns through the layers of the winding yarns at desired locations and locking the binding yarns in place; pushing the binding yarns to the position to form the fabrics and removing any slacks in the yarns and taking up the newly formed fabrics by a controlled distance in the direction of the machine direction, i.e., the longitudinal direction of the fabrics. The newly formed fabric may be condensed in the circumferential direction, thickness direction or a combination of directions by motion of condensing element or elements. The hollow integrated multiaxial fabrics having variable cross sectional shapes, variable yarn orientations, and variable integration patterns are formed by controlling the number of yarn layers engaged, the relative distances of the winding yarn carriers movement, and activation or omission of binding yarns as the forming process proceeds.

FIG. 1 shows schematically an apparatus 100 for fabricating hollow integrated multiaxial fabrics with a prescribed integration pattern according to one embodiment of the present invention. The apparatus 100 has two winding yarn carriers 110*a* and 110*b* arranged in a two-layer structure along a first direction 101 and configured such that each winding yarn carrier 110*a*/110*b* is operationally movable with respect to one another along a second direction 102*a*/102*b* that is perpendicular to the first direction 101. The winding yarns 130 are provided by a plurality of yarn supply packages 120. The yarn supply packages 120 supplying the winding yarns 130 to form each layer of the fabrics are spaced mounted on one individual yarn carrier 110*a*/110*b*. In this exemplary embodiment shown in FIG. 1, a mandrel 103 is employed to take up the fabricated fabric 112, and the ends of the winding yarns 130 extending from the supply yarn packages 120 are incorporated into the fabrics laid on the mandrel 103. The movements of one or more winding yarn carriers 110*a* and 110*b* in opposite directions 102*a* and 102*b* create a plurality of crossover points 132 by the corresponding winding yarns 130.

Figure 7:
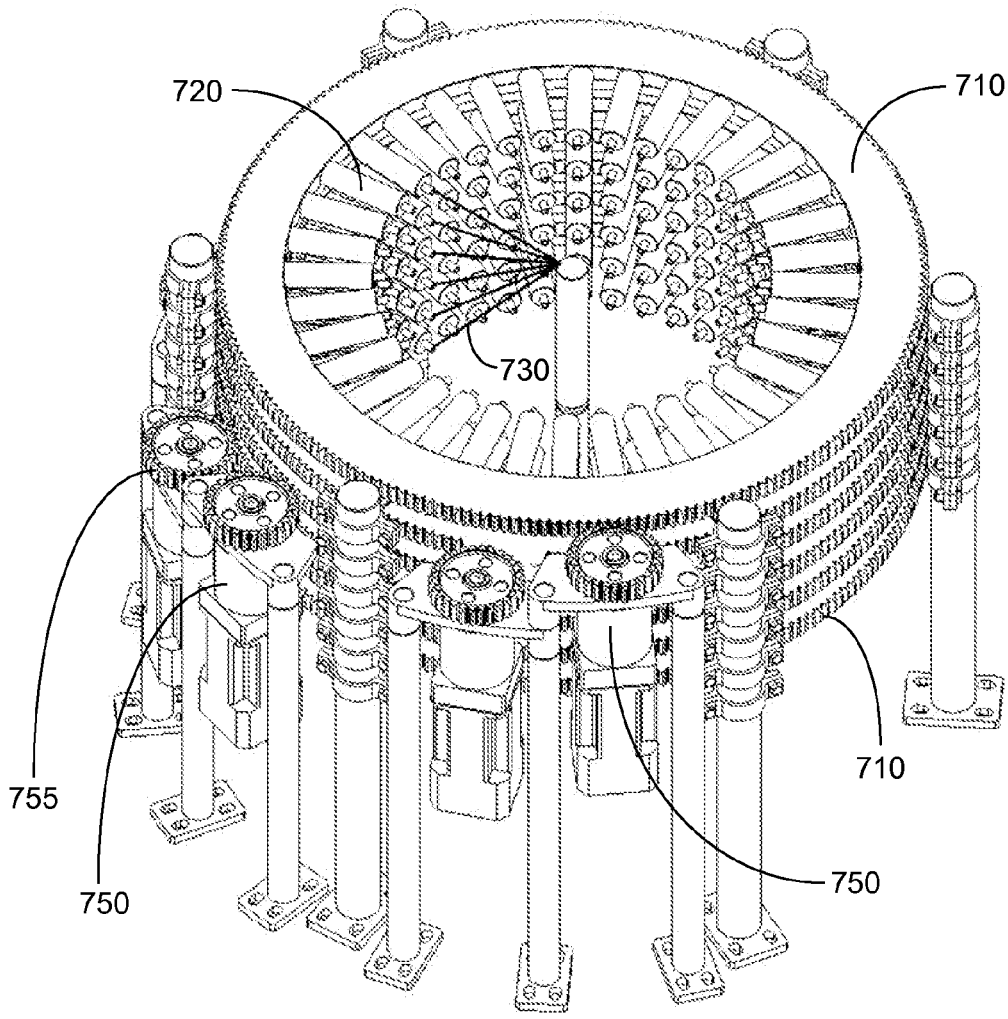
FIG. 7 shows schematically an elevation view of an apparatus for fabricating integrated multiaxial fabrics according to one embodiment of the present invention.

In this embodiment, the winding yarn carriers 110*a* and 110*b* are configured to be angularly rotatable either individually or cooperatively, along the directions 102*a* and/or 102*b*. The rotations of the winding yarn carriers 110*a* and 110*b* are around the axis 101 of the mandrel 103. Accordingly, tubular or tubular-like integrated multiaxial fabrics can be fabricated. In other embodiments, the winding yarn carriers may be configured to be translationally movable either individually or cooperatively along a (second) direction that is perpendicular to a (first) direction along which the winding yarn carriers are aligned/arranged. In operation, the movements of the winding yarn carriers are controlled by a control system (one example of the control system is shown in FIG. 7 below). The prescribed integration pattern is formed by controlling the layer number of the winding yarns, relative distances of the winding yarn carrier movements, the distance of fabric take up in the first direction, and activation or omission of the binding yarns in operation. In yet other embodiments, the axis of the fabric does not coincide with or parallel to the axis of the apparatus (first direction 101). Additionally, two winding yarn carriers 110*a* and 110*b* are utilized in the exemplary embodiment, and thus the supplied winding yarns 130 from the two winding yarn carriers 110*a* and 110*b* form a two winding yarn layers. However, there is no limitation on the number of the winding yarn carriers to be used to practice the present invention. According to the present invention, the number of the winding yarn carriers determines the maximum number of layers of the fabrics to be produced.

Each carrier of the winding yarns places the yarns in a ply at a desired angle by a motion in the circumferential direction such as the rotation of a rigid ring carrier. The winding yarn carriers may be rigid or flexible. Rigid carriers may be circular as described in the example or having other geometric shapes. Examples of flexible carriers include belts, chains, and linked mechanisms moving on tracks.

In one embodiment, winding yarns from some of the winding yarn carriers can be supplied from a stationary creel. These carriers may remain stationary during the process to place 0° layers of winding yarns, or may move in a back and forth motion to form ribs in the fabric.

Packages to supply the winding yarns may contain one yarn per package, or multiple yarns in a single package to supply multiple threads during the winding motion. The packages may be of flanged, cross wound, or other configurations. The winding yarn packages may be placed on the inside face, on the outside face, on a side face, inside the carrier, or by other arrangements.

Additionally, one or more tension control devices (not shown) may be fitted on each winding yarn carrier to regulate the tension of the winding yarns as they are withdrawn. A braking mechanism may be employed as a separate or as a part of the tension control device to prevent the winding yarns from being withdrawn during beat-up.

The apparatus 100 also has one or more binding yarn insertion needles 140 positioned in relation to the plurality of winding yarn carriers 110*a*/110*b* for transporting/inserting binding yarns through the plurality of winding yarn layers at the predetermined locations along the first direction 101, so as to fasten the plurality of winding yarn layers together through-the-layers.

The binding yarns are provided by appropriate packages that can be individual packages or multi-thread packages such as beams. The binding yarns are inserted through the layers of winding yarns 130 at appropriate internals specified by the integration pattern and are locked in place. The binding yarns may be introduced in the through-the-layers direction after the newly laid winding yarns 130 are condensed together, much like in sewing. The sewing-type of layer integration may result in some impalement of the winding yarns. Additionally, the binding yarns can be inserted through the gaps between the newly formed crossover points 132 of the winding yarns 130 to avoid impalement of the winding yarns, as in the case of the illustrative example presented earlier.

According to embodiments of the present invention, various binding yarns, different in type, such as filament, yarn and tape, different in form, such as solid and tubular, different in material and in size, can be used to practice the present invention.

In embodiments shown in FIGS. 1 and 3-6, a plurality of binding yarn insertion needles 140 is utilized to insert the binding yarns through the layers of winding yarns to form open loops by the folded binding yarns. The apparatus 100 may also have a holding yarn feeding needle 172 and a holding yarn insertion needle 174 positioned in relation to the plurality of binding yarn insertion needles 140. When the plurality of binding yarn insertion needles 140 inserts the binding yarns through the plurality of winding yarn layers to form open loops by folding the binding yarns, the holding yarn feeding needle 172 and the holding yarn insertion needle 174 move a holding yarn through the binding yarn open loops to lock the binding yarns in the fabrics.

Preferably, the apparatus 100 is equipped with the same number of needle sets for the binding yarn and the holding yarn as the number of winding yarn packages for fast operating speed. The motion of each needle set follows the command by the control system. As a minimum, only one holding yarn needle pair is needed. In such a case the needle pair completes one turn of movement in the circumferential direction relative to the laid winding yarn layers in each fabrics forming cycle.

There are several options for the mechanisms of inserting and locking the binding yarn in place, including a variety of knitting mechanisms, rapier yarn transfer mechanisms, shuttles, sewing stations, self-locking, among others.

As shown in FIG. 1, the apparatus 100 also has one or more beating bars 160 adapted for inserting through openings of the laid winding yarns for a beat-up motion at a predetermined time to push the binding yarns toward the fell 105 of the fabrics.

In operation, the one or more beating bars 160 penetrates through openings of the laid winding yarns 130 for the beat-up motion at appropriate time to push the winding yarns 130 toward the fabrics fell 105 in preparation for binding yarn insertion. The beat-up motion prior to binding yarn insertion allows the binding yarns to be placed as close to the fabrics fell 105 as possible. The beating bar may be fitted with rotating wheels or low friction materials, together with appropriate geometry, to minimize abrasion and damage to the winding yarns. Alternatively or in addition to the pre-insertion beat-up, a post-insertion beat-up motion may follow the binding yarn insertion to push the newly inserted binding yarn to the fabrics fell 105. Similar motion may be accomplished with a single beating bar traveling in the circumferential direction, although multiple bars are preferred for operation effectiveness and efficiency.

The apparatus 100 further comprises a plurality of shaping rings 151, 153 and a moving ring 155 adapted for condensing the plurality of winding yarn layers and supporting the winding yarn layers while the binding yarns are inserted and during the beat-up motion. The position of the moving ring 155 is changeable during each cycle of fabrics formation.

In addition, the apparatus 100 may further have an auxiliary bar (not shown) accompanying each binding yarn insertion needle 140 for keeping the binding yarn loop open while the holding yarn is inserted, and for tightening the binding yarn after the holding yarn is inserted while limiting the bending curvature in the binding yarn as it is tightened.

The apparatus may include a knitting mechanism having a needle and a yarn feeder to form a loop of the holding yarn that goes through the open loop of the folded binding yarn, wherein the holding yarn is adapted for holding the binding yarn in place, and preventing the binding yarn from being pulled out as the binding yarn insertion needle retreats and the slacks in the binding yarn is removed.

According to the present invention, hollow integrated multiaxial fabrics can be produced in connection with the apparatus as disclosed above, according to the following steps: at first, a plurality of crossover points of the winding yarns is formed by moving at least one winding yarn carrier along the second direction. The movements are controlled by the control system according to the integration pattern. Then, the binding yarns are transported or inserted through the plurality of winding yarn layers at predetermined locations along the first direction and are locked in place. The binding yarns are pushed toward the plurality of crossover points of the winding yarns to form integrated multiaxial fabrics. A condensing motion, if desired, further compacts the fabric. The formed integrated multiaxial fabrics are then taken up. The above steps are repeated until the integrated multiaxial fabric is fabricated to have desired dimensions.

The process can be operated in a continuous or stepwise motion with the synchronization of the motions of the winding yarn carriers, binding yarn insertion, beat-up and take-up of the fabrics.

Figure 2:
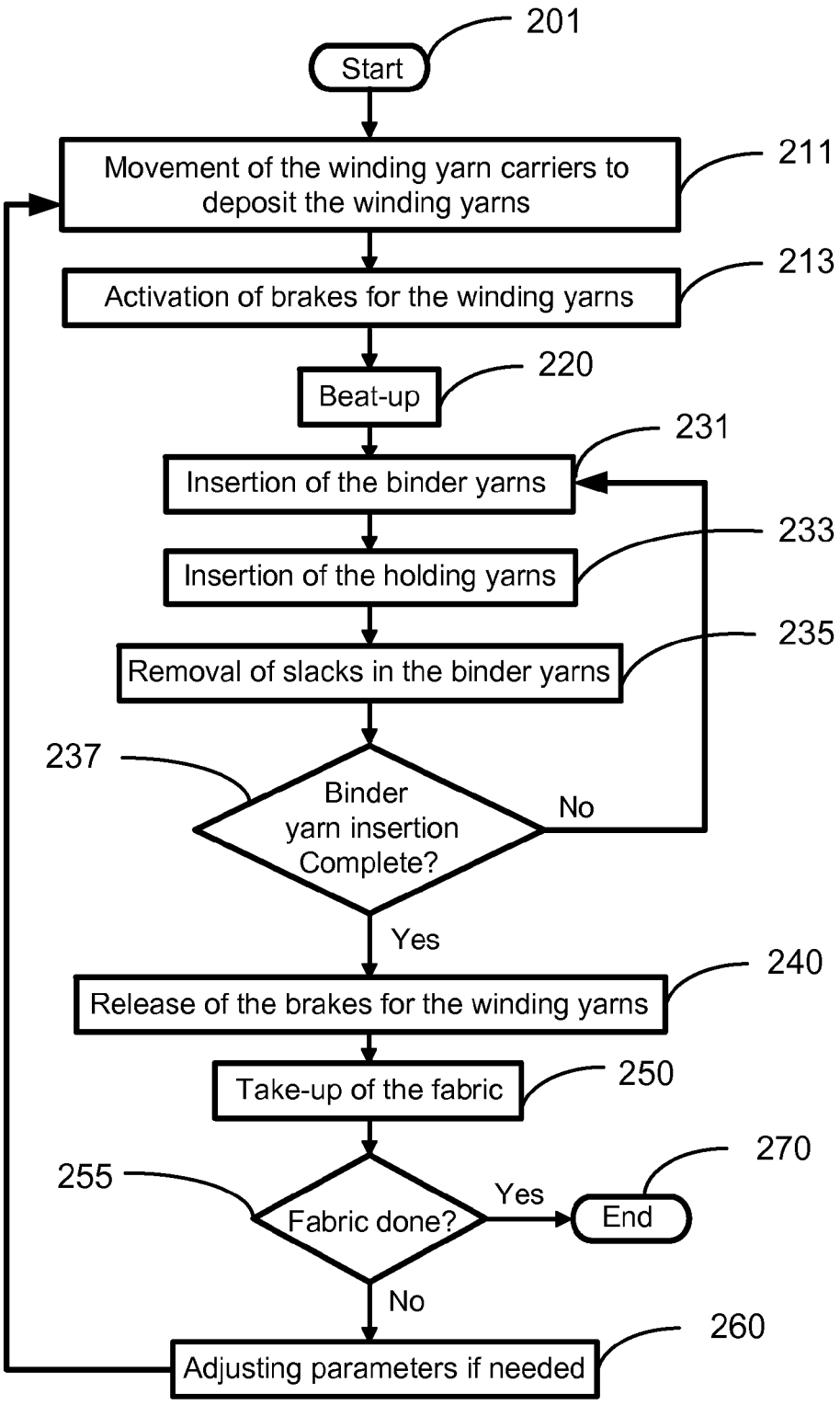
FIG. 2 shows a flow chart of a method for fabricating integrated multiaxial fabrics according to one embodiment of the present invention.
Figure 3:
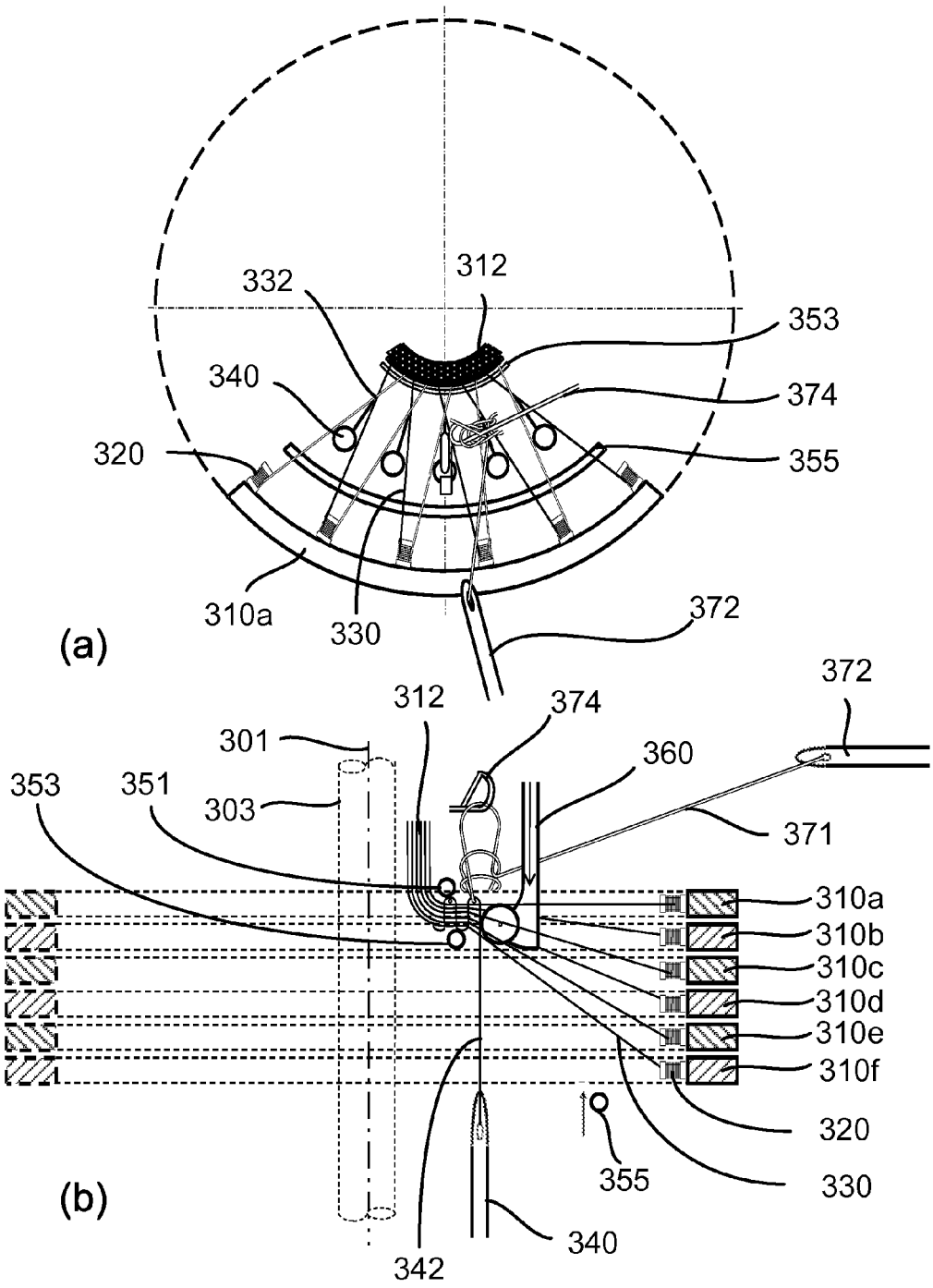
FIGS. 3*a*, 3*b*, 4*a*, 4*b*, 5*a*, 5*b*, 6*a*, 6*b* show schematically a sequential process for fabricating integrated multiaxial fabrics in connection with an apparatus according to one embodiment of the present invention, (a) a top view of the apparatus, and (b) a cross-sectional view of the apparatus.

Referring to FIGS. 2 and 3, and particularly to FIG. 2, a flow chart for fabricating integrated multiaxial fabrics is shown according to one embodiment of the present invention. In this embodiment, six ring-like winding yarn carriers 310*a*-310*f* are employed.

Before starting the process, each winding yarn carrier 310*a*, 310*b*, 310*c*, 310*d*, 310*e* or 310*f* is furnished with winding yarn packages 320 and the yarn ends are tied to the mandrel 303 placed inside the ring 351 along the mandrel axis 301 whose diameter matched the inner diameter of the tubular fabrics 312 to be produced. After an initial run to reach steady-state at step 201, the following steps complete one cycle: at step 211, winding yarn carriers 310*a*-310*f* are moved, according to the designed/prescribed fabrics pattern, to deposit the winding yarns 330. In this embodiment, winding yarn carriers 310*a* (top) and 310*f* (bottom) move in the positive (counterclockwise) direction for one step, winding yarn carriers 310*b* and 310*e* in the negative (clockwise) direction for one step, winding yarn carrier 310*c* remains stationary, and winding yarn carrier 310*d* completes one revolution. Then, the brakes for the winding yarns 330 are activated for stopping depositing the winding yarns 330 at step 213. At step 220, the beating bar 360 moves to the fabrics fell for beat-up and then retreats. At step 231, the binding yarn 342 is inserted through the openings between the winding yarn crossover points 332. The binding yarn 342 is inserted and locked in place by a holding yarn 371 at step 233. At step 235, any slacks in the binding yarn and holding yarn are removed. The control system (not shown) determines whether the binding yarn insertion is complete at step 237. If the binding yarn insertion is not complete, the process will repeat until each binding yarn loop inserted through the winding yarn layers is locked in place by the holding yarn. Otherwise, the fabrics may be optionally condensed and the brakes for the winding yarns 330 are released at step 240. Then, the fabricated fabric 312 is taken up by the mandrel 303 in a pre-set distance or rate at step 250. The control system determines whether the desired fabrics are done at step 255. If the desired fabrics are done, the fabricating process ends at step 270. Otherwise, the parameters may be adjusted if needed at step 260, then, the process is repeated from step 211.

The processing sequence may be adjusted and the motions may be continuous or stepwise. The combination of the speeds of the winding yarn carriers (step size of carrier motion) and the speed of fabrics take-up in the machine direction (step size of mandrel movement) determines the local yarn orientations in the fabrics. By varying the speed of the yarn carriers relative to that of fabrics take-up, the yarn orientations can be altered as required. Therefore it is possible to produce fabrics with varying ply angles along the length by adjusting the relative speeds of winding and take up as the fabrics are formed. To wind the layer at close to 90°, the number of active yarns drawn from packages should be limited or thinner yarns should be used accordingly for desired layer thickness.

FIGS. 3-6 show schematically one example of the binding yarn insertion and the corresponding locking mechanism according to one embodiment of the present invention. Auxiliary parts and some movements of the parts are omitted herewith as they are known to people skilled in the art. A plurality of binding yarn insertion needles 340 insert the binding yarns 342 through the layers of winding yarns 330 to form open loops defined by the folded binding yarns such that a holding yarn 371 may go through the loops to lock the binding yarns 342. An auxiliary bar (not shown) may accompany each binding yarn insertion needle 340 to keep the binding yarn loop open while the holding yarn 371 is inserted, and to help tightening the binding yarn 342 after the holding yarn 371 is inserted while limiting the bending curvature in the binding yarn 342 as it is tightened. A knitting mechanism including a needle and yarn feeder forms a loop of the holding yarn which goes through the open loop of the folded binding yarn. The purpose of the holding yarn 371 is to hold the binding yarn 342 in place in the fabrics 312, and to prevent the binding yarn 342 from being pulled out as the binding yarn insertion needle 340 retreats and the slacks in the binding yarn 342 is removed.

The sequence of forming holding yarn loops to lock the binding yarn is as follows, with steps (a) to (d) illustrated in FIGS. 3-6, respectively:

At step (a), as shown in FIG. 3, the moving ring 355 is lowered to reduce friction among the winding yarns 330 as a given amount of winding yarns 330 are released by the angular motion of the winding yarn carriers 310*a*-310*f*. The beating bar 360 is pushed into the winding yarn layers for beat-up prior to binding yarn insertion, and then the moving ring 355 is raised to condense the winding yarn layers. The beating bar 360 is then retreated.

Figure 4:
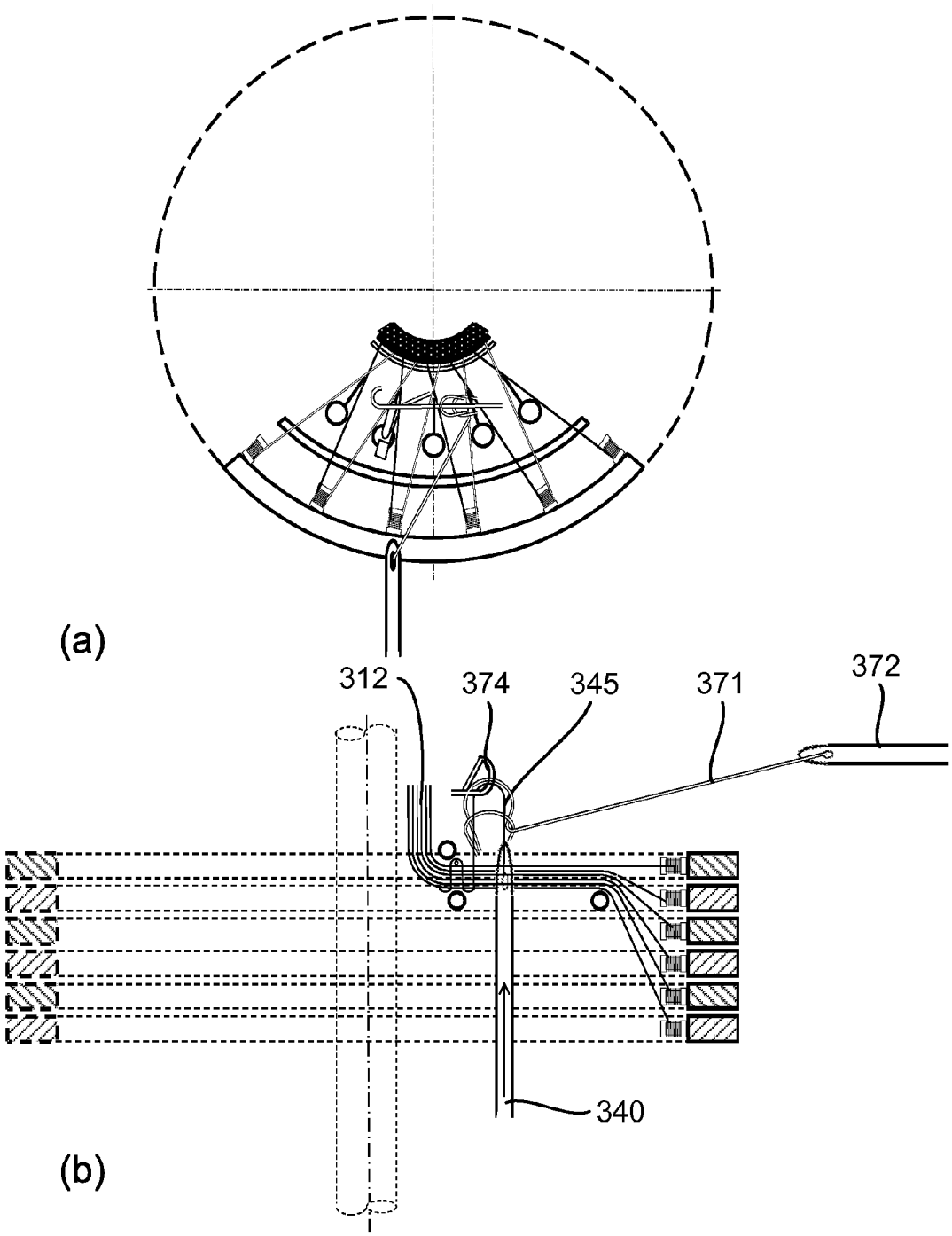

At step (b), as shown in FIG. 4, the binding yarn insertion needles 340 penetrate through the openings in the winding yarn layers to expose holding open loops 345 on the top surface of the fabrics 312. The holding yarn insertion needle 374 penetrates through the binding yarn loop 345.

Figure 5:
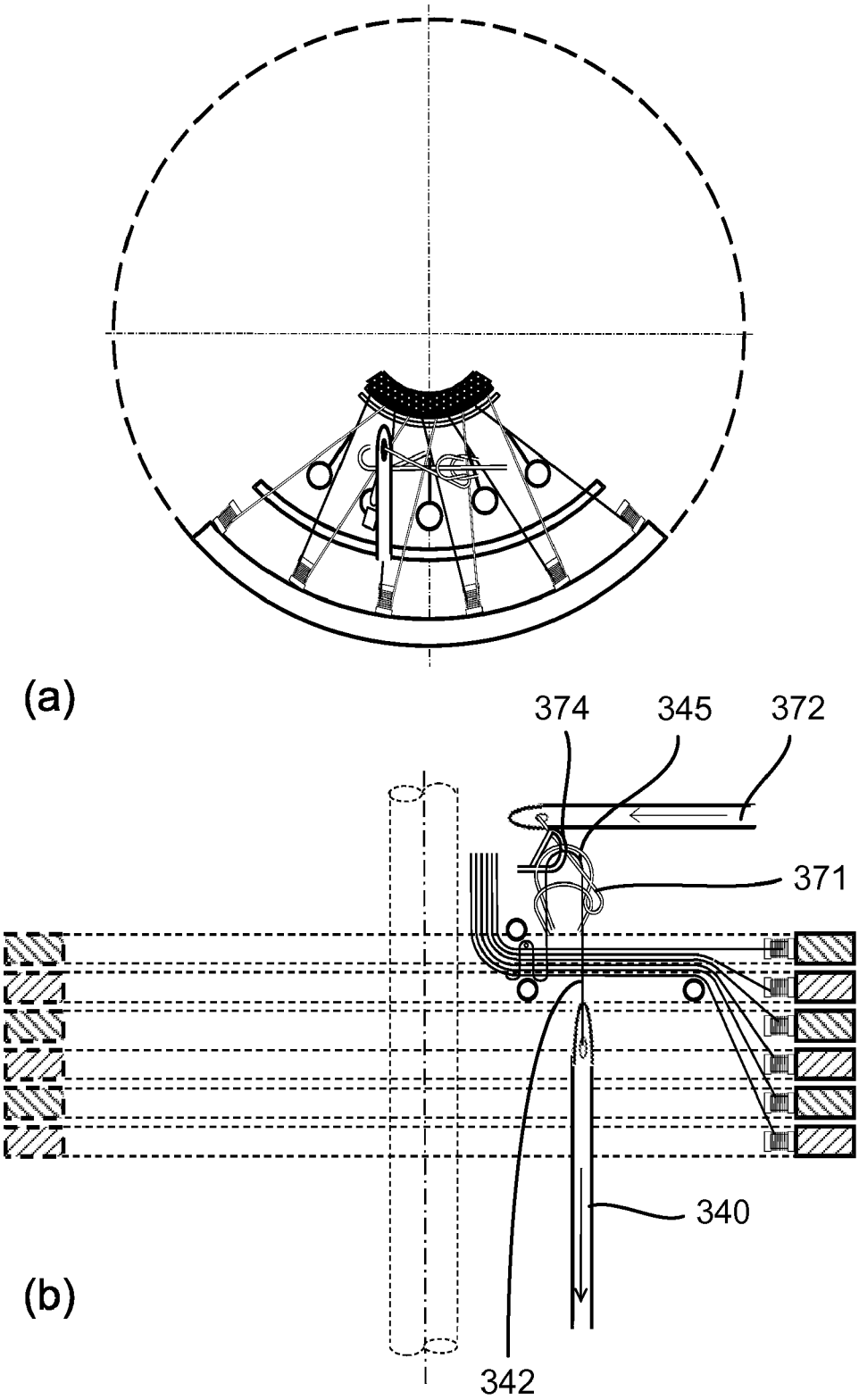

At step (c), as shown in FIG. 5, the binding yarn insertion needles 340 retreat from the top surface of the fabrics 312 without tightening the binding yarn 342. The holding yarn feeding needle 372 moves inward so as to feed the holding yarn 371 to the hook of the holding yarn insertion needle 374.

Figure 6:
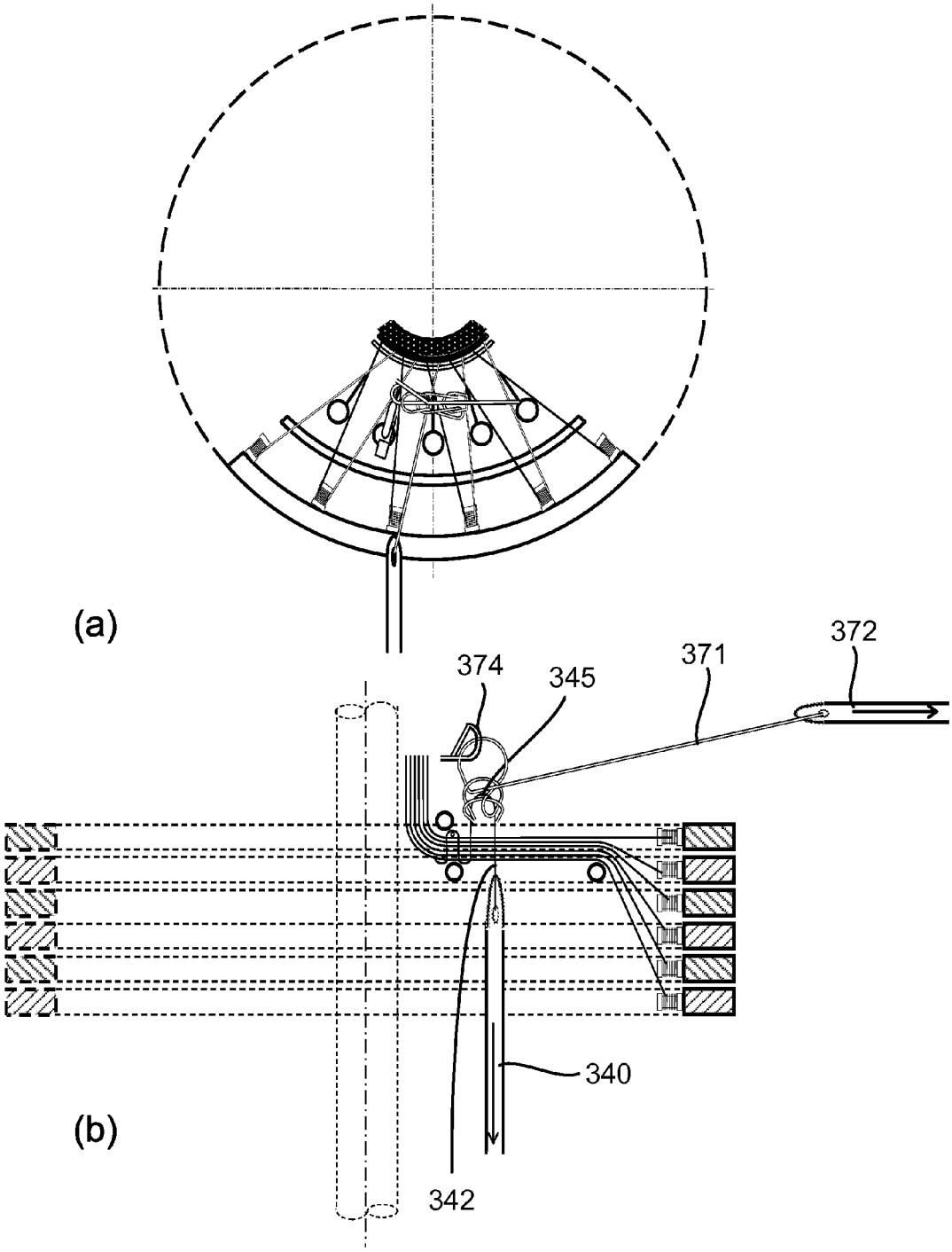

At step (d), as shown in FIG. 6, the holding yarn insertion needle 374 retreats through the binding yarn loop 345 and lock the holding yarn 371 into the previous holding yarn loop. The binding yarn 342 is tightened as the binding yarn insertion needle 340 retreats further.

The holding yarn insertion mechanism moves circumferentially to the next binding yarn location, and steps (c) and (d) are repeated until all the binding yarns 342 are locked and tightened.

There are several other options for the mechanisms of holding yarn placement, including a variety of knitting mechanisms, rapier yarn transfer mechanisms, shuttles, sewing stations, self-locking, among others.

The newly formed fabric may be condensed in any direction or directions relative to the fabric, including circumferential direction, thickness direction or a combination of directions, by motion of condensing element or elements (not shown). The mandrel carrying the fabrics advances upward for fabrics take-up.

The above steps are repeated until the entire piece of fabrics is completed.

In this illustrative example, the mandrel carrying the finished fabrics moves upwards such that the holding yarn (or binding yarn if holding yarn is not used) loops will be on the outer surface of the fabrics. Alternatively, the mandrel and the fabrics can move through the rings downwards such that the loops formed by the holding yarn (or binding yarn if holding yarn is not used) appear on the inner surface of the fabrics.

According to the present invention, the insertion and locking of each binding yarn by the holding yarn at any given point can be executed or omitted via the control system, and therefore the integration pattern can be altered as desired even within the same piece of fabrics. According to embodiments of the present invention, the various fabric structures can be formed, including hybrid structures of which the fiber architecture varies from locations to locations, by controlling the relative movements among the winding yarn carriers, the relative speed of each winding yarn carrier relative to the speed of fabric take-up, and/or the patterns of binding the winding yarn layers.

FIG. 7 shows schematically one embodiment of a driving (control) system to control the movements of the winding yarn carriers according to the present invention. The apparatus 700 has six winding yarn carriers 710 arranged in a six-layer structure along a vertically direction. The winding yarns 730 are provided by a plurality of yarn supply packages 720. The yarn supply packages 720 supplying the winding yarns 730 to form each layer of the fabrics are spaced mounted on one individual yarn carrier 710. In the exemplary embodiment, each winding yarn carrier 710 is driven by a respective motor 750 through a transmission system. For the illustration propose, only four motors 750 are shown in the figure. The transmission system in the example includes a gear 755 coupled to the motor 710 and meshing with a corresponding winding yarn carrier 710, such that when the motor 710 is activated, the rotation of the motor 710 drives the gear 755 to rotate, which in turn, drives the corresponding winding yarn carrier 710 to rotate. The operation of the motors 755 can be controlled by, for example, one or more microcontrollers (not shown). For such an apparatus 700, one can program the one or more microcontrollers based on a prescribed integration pattern of fabrics to control the movements of the motors 755, and therefore, the movements of the winding yarn carriers 710, so as to obtain the prescribed integration pattern of fabrics. The movement of each winding yarn carrier 710 can be continuous, step-wise, reciprocating and/or stationary, controlled by the respective motor 750.

Figure 8:
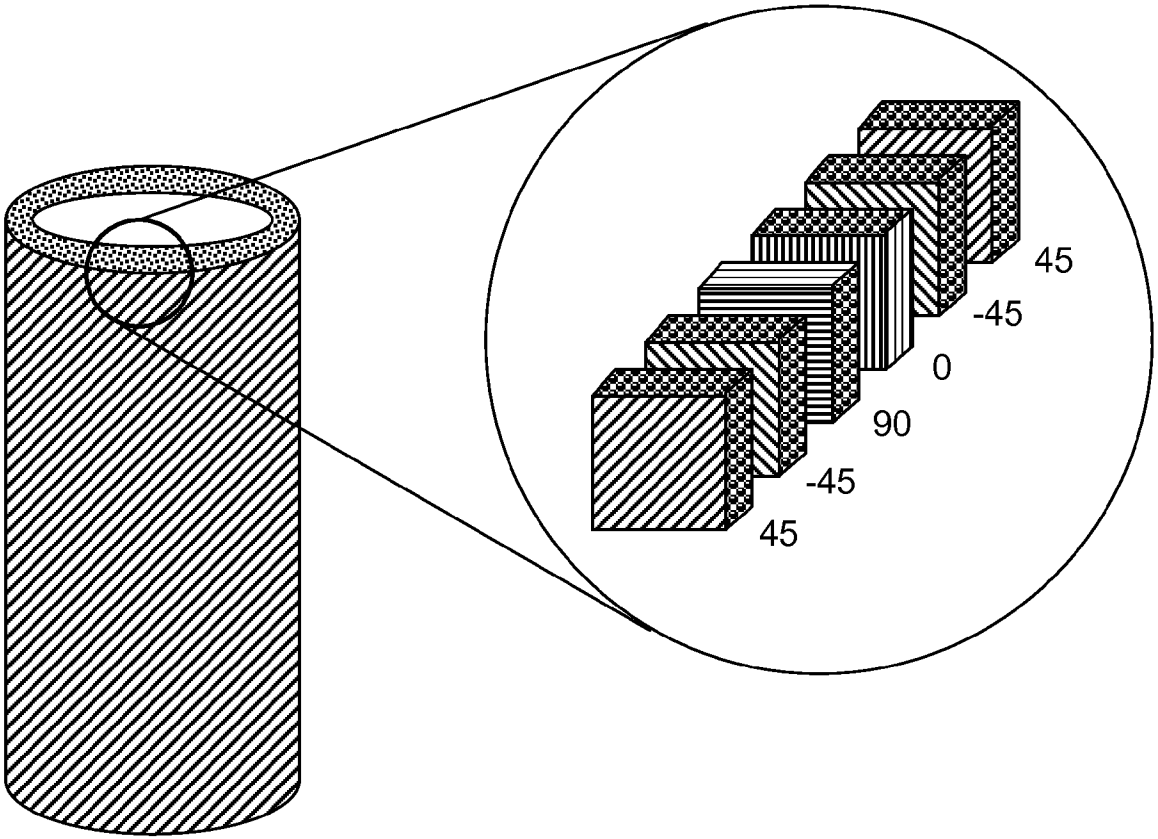
FIG. 8 shows schematically tubular fabrics with a [45/−45/0/90/−45/45] layup according to one embodiment of the present invention, where the ply orientations from inner surface to outer surface are given in degrees.

The movements of one or more winding yarn carriers in opposite directions create a plurality of crossover points by the corresponding winding yarns, which influence the pattern of the fabrics. FIG. 8 shows an example of tubular fabrics with a [45/−45/0/90/−45/45] layup, according to one embodiment of the present invention, where the ply orientations from inner surface to outer surface are given in degrees.

Figure 9A:
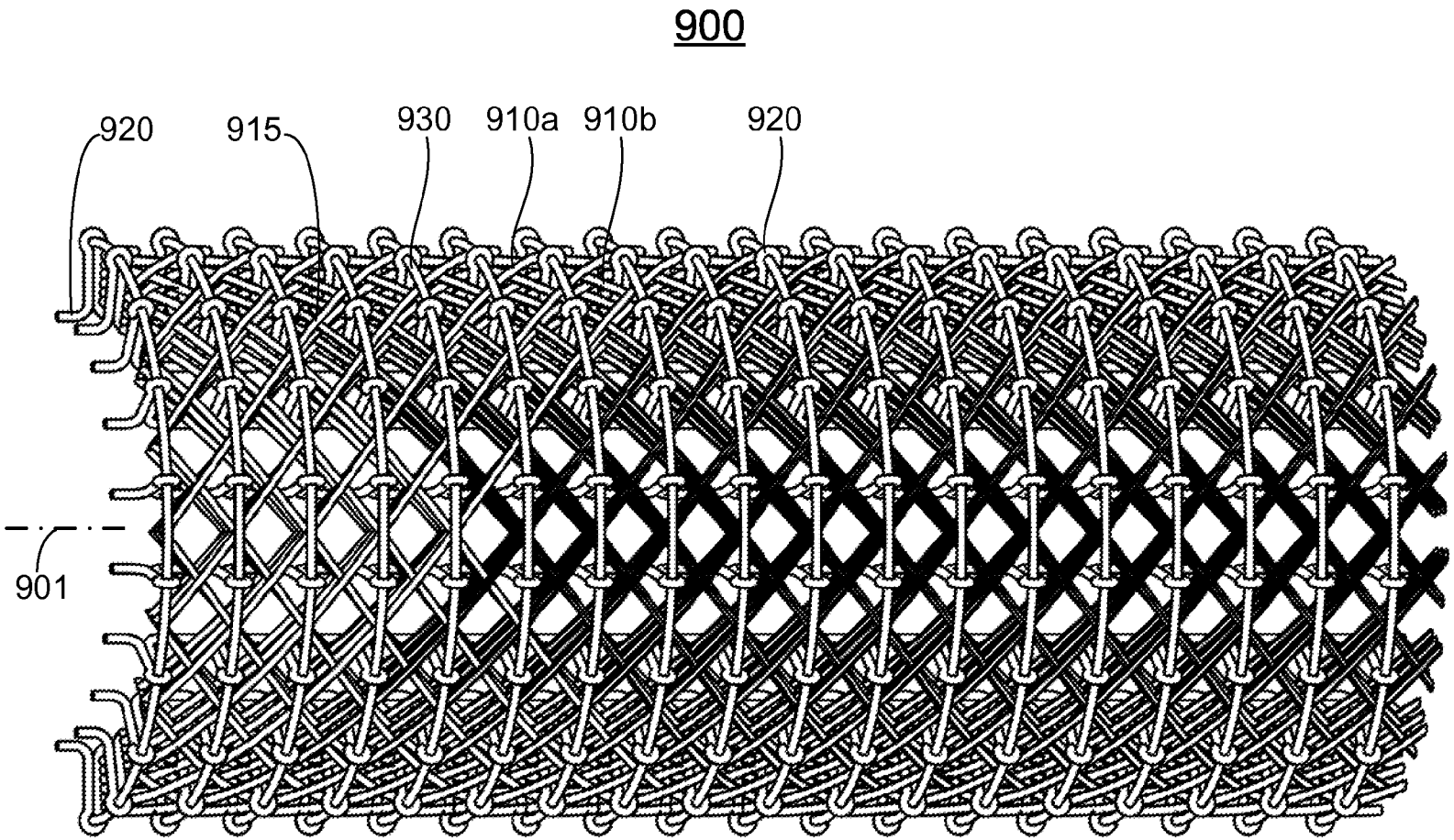
FIGS. 9A-9C show schematically different views of a hollow integrated multiaxial fabric according to one embodiment of the present invention, A) a perspective view, B) a cross sectional view and C) another cross-sectional view.
Figure 9B:
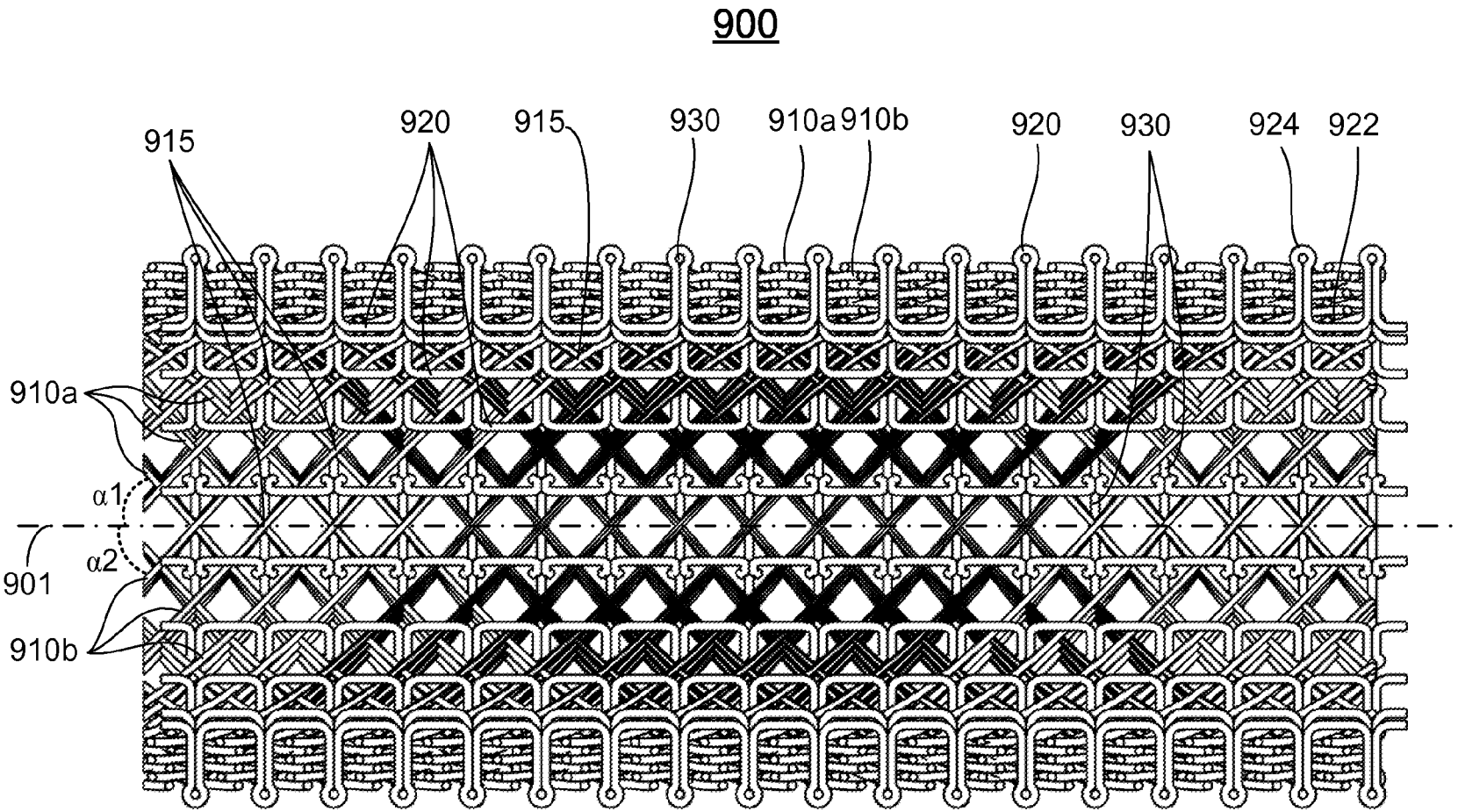
Figure 9C:
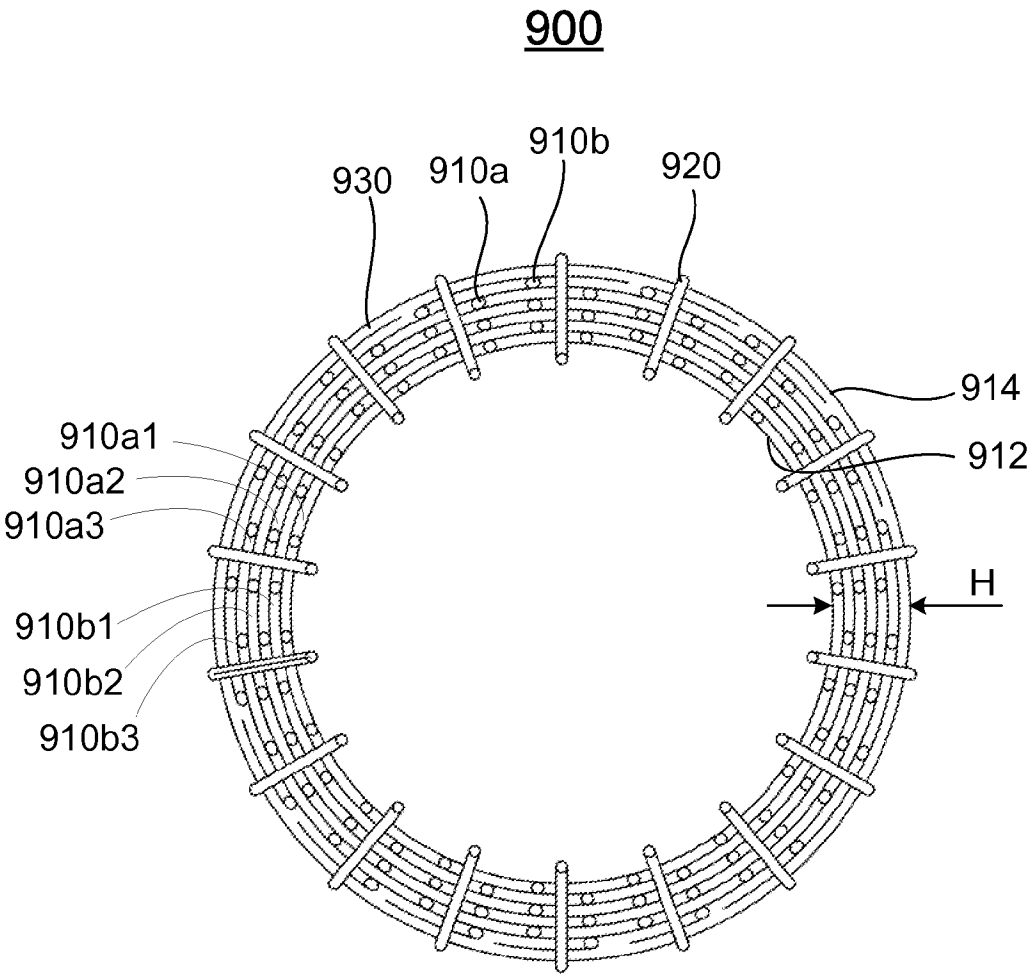

FIGS. 9A-9C show an exemplary hollow integrated multiaxial fabric 900 according to the present invention. The hollow integrated multiaxial fabric 900 has a generally cylindrical shape having a central axis 901.

The hollow integrated multiaxial fabric 900 includes first and second groups of winding yarns. Each group has a plurality of winding yarns 910*a* (910*b*) regularly arranged in three layers 910*a*1, 910*a*2, 910*a*3 (910*b*1, 910*b*2, 910*b*3). The winding yarn layers 910*a*1, 910*a*2 and 910*a*3 of the first group, and the winding yarn layers 910*b*1, 910*b*2 and 910*b*3 of the second group are alternately stacked in the radial direction to define an inner surface 912, an outer surface 914 and a radial thickness, H, therebetween, as shown in FIG. 9C. For example, the layer 910*b*1 is disposed on the layer 910*a*1, the layer 910*a*2 is disposed on the layer 910*b*1, and so on. The number of layers formed by winding yarns may be adjusted as needed.

The plurality of winding yarns 910*a* (910*b*) of each group is disposed substantially in parallel to one another. The plurality of winding yarns 910*a* of the first group is helically oriented at a first angle, $\alpha 1$, relative to the central axis 901. The plurality of winding yarns 910*b* of the second group is helically oriented at a second angle, $\alpha 2$, relative to the central axis 901. According to the invention, $-90° < \alpha 1 < 90°$, and $-90° < \alpha 2 < 90°$. Preferably, $\alpha 2 = -\alpha 1$. When $\alpha 1$ and/or $\alpha 2$ are near 0°, the winding yarns are placed in the longitudinal direction of the fabric, and when $\alpha 1$ and/or $\alpha 2$ are close to 90° or −90°, the winding yarns are placed in the circumferential direction of the fabric. The angle $\alpha 1$ of different winding yarn layers of the first group may be the same or substantially different. Similarly, the angle $\alpha 2$ of different winding yarn layers of the second group may be the same or substantially different.

Further, the plurality of winding yarns 910*a* of the first group and the plurality of winding yarns 910*b* of the second group define a plurality of crossovers 915.

The hollow integrated multiaxial fabric 900 further includes a plurality of binding yarns 920. Each binding yarn 920 defines alternately a plurality of binding loops 922 and a plurality of holding loops 924 interlaced with corresponding crossovers 915 for interlocking the winding yarn layers 910*a*1, 910*a*2, 910*a*3, 910*b*1, 910*b*2 and 910*b*3 of the first and second groups. As shown in FIGS. 9A and 9B, each binding loop 922 receives a crossover 915 at the inner surface 912, and each holding loop 924 is placed between crossovers 915 and exposed to the outer surface 914.

The hollow integrated multiaxial fabric 900 may also include one or more holding yarn 930 that are received in the holding loops 924 of the plurality of binding yarns 920, and disposed on the outer surface 914 circumferentially. The integration pattern may be varied. In one embodiment, the holding yarn is entirely omitted by self-locking the binding yarns. In another embodiment, the holding yarn is disposed on the outer surface in a direction other than the circumferential direction. In yet another embodiment, the binding loops formed by a binding yarn may receive more than one crossovers.

According to the present invention, hollow integrated multiaxial fabrics can be fabricated with two systems of yarns: the winding yarns and the binding yarns. The winding yarns are arranged in a plurality of layers at prescribed angles that can vary in the ranges from about −90° to about +90° with respect to longitudinal direction of the fabrics. The binding yarns are used to fasten the desired layers of the winding yarns together. The number of the layers of winding yarns can be varied as desired but limited by the number of winding yarn carriers in the apparatus. In one embodiment, the layers of winding yarns may be shaped by an optional mandrel of appropriate geometry along the machine direction to form hollow integrated multiaxial fabrics or fabrics with a core. The winding yarn orientations for the individual layers can be altered for different locations within the fabrics as the fabrics are being formed.

If used, the optional mandrel may be removed from the completed fabric, or the mandrel may remain in the completed fabric as part of the fabric. In the latter case, the mandrel may be made of a light-weight core material, a fiber assembly, a reinforced composite, among others.

In sum, the present invention, among other things, recites a hollow integrated multiaxial fabric and its variants, a method and an apparatus for fabricating integrated multiaxial fabrics with the winding yarns arranged in a plurality of layers at prescribed angles bound together by a set of through-the-layers yarns. The integrated multiaxial fabrics can be tailored to have a variety of constant or variable cross sectional shapes, constant or variable fiber orientation and integration patterns according to requirements for local fiber architecture and fabrics geometry.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A method for fabricating a fabric, comprising the steps of:

(a) providing a plurality of yarn carriers configured along a first direction such that each yarn carrier is operationally movable with respect to one another along a second direction that is different from the first direction, wherein each yarn carrier supplies yarns from one or more yarn packages to form a yarn layer, whereby the yarns from the plurality of yarn carriers form a plurality of yarn layers;

(b) forming a plurality of crossover points of the yarns by moving at least one yarn carrier along the second direction;

(c) transporting yarns through the plurality of yarn layers, and locking the through-layer yarns in place;

(d) pushing the through-layer yarns toward the fell of the fabric, if needed;

(e) taking up the formed fabric; and (f) repeating steps (b)-(e) until the fabric is fabricated to have desired dimensions.

2. The method of claim 1, wherein the through-layer yarns are transported by a yarn insertion system having at least one yarn insertion needle positioned in relation to the plurality of yarn carriers, and wherein the transporting step is performed by passing at least one yarn insertion needle of the yarn insertion system through the plurality of yarn layers, so as to fasten the plurality of yarn layers together through-the-layers.

3. The method of claim 1, wherein mechanisms of transporting and locking the through-layer yarns in place include a variety of knitting mechanisms, rapier yarn transfer mechanisms, shuttles and sewing stations.

4. The method of claim 1, wherein the one or more yarn packages to supply the in-layer yarns, comprise one yarn per package or multiple yarns in a single package supplying multiple threads.

5. The method of claim 1, wherein the in-layer yarns are supplied from packages mounted on the yarn carriers or mounted on separate creels.

6. The method of claim 1, wherein the formed fabric structure is variable with the number of layers of the yarns, the yarn carrier movements, distance of fabric take up, and activation or omission of transporting the through-layer yarns.

7. The method of claim 1, wherein more than one through-layer yarns are transportable by the yarn insertion system through the plurality of yarn layers, wherein at least one through-layer yarn is acting to fasten the plurality of yarn layers together through-the-layers.

8. An apparatus for fabricating fabrics, comprising:

(a) a plurality of yarn carriers configured along a first direction such that each yarn carrier is operationally movable with respect to one another along a second direction that is different from the first direction, wherein each yarn carrier supplies yarns from yarn packages to form a yarn layer, whereby the yarns from the plurality of yarn carriers form a plurality of yarn layers, and wherein a plurality of crossover points of the yarns formed by moving at least one yarn carrier along the second direction; and (b) a yarn insertion system positioned in relation to the plurality of yarn carriers for transporting yarns through the plurality of yarn, so as to fasten the plurality of yarn layers together through-the-layers.

9. The apparatus of claim 8, further comprising a plurality of rings adapted for condensing and supporting the yarn layers.

10. The apparatus of claim 8, further comprising a unit for condensing the formed fabric.

11. The apparatus of claim 8, further comprising at least one yarn locking system accompanying and positioned in relation to the yarn insertion system such that when the yarn insertion needles transport the through-layer yarns through the plurality of yarn layers to form open loops by folding the through-layer yarns, the yarn locking system lock the through-layer yarns in the fabrics.

12. The apparatus of claim 11, wherein the at least one yarn locking system comprises a knitting mechanism having a needle and a yarn feeder to form a yarn loop that goes through the open loop of the folded through-layer yarn, for locking the through-layer yarn in place.

13. The apparatus of claim 8, further comprising one or more tensioning control devices placed for regulating the tension of the yarns as the yarns are withdrawn.

14. The apparatus of claim 13, wherein the one or more tensioning control devices comprise a braking mechanism for preventing the in-layer yarns from being withdrawn during the beat-up motion.

15. The apparatus of claim 8, wherein each yarn carrier is angularly or translationally movable along the second direction.

16. The apparatus of claim 8, wherein the yarn carriers are rigid or flexible.

17. The apparatus of claim 8, being operable in a continuous or stepwise motion with the synchronization of the motions of the yarn carriers, yarn insertion, beat-up and take-up of the fabric.

18. A method for fabricating fabrics in connection with an apparatus comprising:

(a) a plurality of yarn carriers configured along a first direction such that each yarn carrier is operationally movable with respect to one another along a second direction that is different from the first direction, wherein each yarn carrier supplies yarns to form a yarn layer, whereby the yarns from the plurality of yarn carriers form a plurality of yarn layers, and wherein a plurality of crossover points of the yarns are formed by moving at least one yarn carrier along the second direction;

(b) a yarn insertion system positioned in relation to the plurality of yarn carriers; and (c) at least one beating bar, wherein the method comprises the steps of:

(a) moving at least one yarn carrier along the second direction to form a plurality of crossover points of the yarns;

(b) inserting at least one yarn insertion needle of the yarn insertion system through the plurality of yarn layers for transporting the yarns through the plurality of yarn layers, folding and forming open yarn loops;

(c) locking the inserted yarns in place, so as to fasten the plurality of yarn layers together through-the-layers;

(d) inserting the at least one beating bar through openings of the laid in-layer yarns for a beat-up motion to push the through-layer yarns toward the fell of the fabrics;

(e) taking up the formed; and (f) repeating steps (a)-(e) until the fabric is fabricated to have desired dimensions.

19. The method of claim 18, wherein the apparatus further comprises at least one yarn locking system accompanying the yarn insertion system and a yarn locking system having a hook, positioned in relation to the yarn insertion system.

20. The method of claim 18, wherein the step of locking the yarns in place comprises the steps of:

(a) inserting the needle of the yarn locking system through the through-layer yarn loop;

(b) retreating the yarn insertion needle associated with the yarn loop from the top surface of the fabrics without tightening the yarn;

(c) moving the needle of the yarn locking system inward to feed a yarn to its hook;

(d) retreating the needle of the yarn locking system through the through-layer yarn loop and interlock the yarn into a prior yarn loop;

(e) tightening the through-layer yarn as the needle of the yarn locking system retreats further; and (f) moving the needle of the yarn locking system circumferentially to a next through-layer yarn loop; and (g) repeating steps (a)-(f) until all the through-layer yarns are locked and tightened in place.

21. The method of claim 18, further comprising the step of beating up the yarn layers before the transporting step is performed.

22. An hollow integrated multiaxial fabric of a generally cylindrical shape having a central axis, comprising:

(a) yarn layers stacked in the radial direction, wherein a plurality of yarns is regularly arranged and helically oriented at an angle, $\alpha$, relative to the central axis, in each layer, respectively, wherein at least one yarn layer having the yarns helically oriented at an angle, $\alpha$, which is different from the angle(s) at which yarns in other yarn layers are helically oriented thereby defining a plurality of crossovers; and (b) a plurality of through-layer yarns, each through-layer yarn defining a plurality of loops interlaced with corresponding crossovers for interlocking the yarn layers, wherein each loop receives at least one crossover at one surface and is placed between crossovers and exposed to the other surface, wherein the plurality of through-layer yarns interlocked themselves or locked by other yarn(s).

23. The hollow integrated multiaxial fabric of claim 22, wherein the angle, $\alpha$, is in the range between $-90°$ and $+90°$.

24. An hollow integrated multiaxial fabric, comprising:

(a) a body having an axis and a thickness along a direction perpendicular to the axis;

(b) yarns space-regularly disposed and inclined with respect to the axis of the body at an angle, $\alpha$, respectively, in each layer, which are stacked, interlocked together, and embedded, in the thickness of the body, respectively, wherein the yarn orientation in at least one yarn layer is different from that in other yarn layers to define a plurality of crossovers; and (c) a group of yarns through the thickness of the body to fasten the layers together, wherein the positions and the pattern of interlock vary according to the need wherein this group of yarn interlocked themselves or locked by other yarn(s).

25. The hollow integrated multiaxial fabric of claim 24, wherein the yarns are inclined at an angle, $\alpha$, relative to the axis of the body, wherein the angle, $\alpha$, is in the range between $-90°$ and $+90°$.

26. The hollow integrated multiaxial fabric of claim 24, wherein the body has a cross-section geometry that is in a regular or irregular shape with uniform or variable thickness.

27. The apparatus of claim 8, further comprising at least one beating bar adapted for inserting through openings of the yarns for a beat-up motion to push the yarns toward the fell of the fabric.

28. The method of claim 18, wherein the in-layer yarns can be supplied from packages mounted on the yarn carriers or mounted on separate creels.

29. The method of claim 1, wherein the second direction is perpendicular to the first direction.

30. The apparatus of claim 8, wherein the second direction is perpendicular to the first direction.

31. The method of claim 18, wherein the second direction is perpendicular to the first direction.

* * * * *